United States Patent [19]

Ten Eyck

[11] Patent Number: 4,863,700

[45] Date of Patent: Sep. 5, 1989

[54] MONOLITHIC CATALYTIC CONVERTER MOUNTING ARRANGEMENT

[75] Inventor: John D. Ten Eyck, Lewiston, N.Y.

[73] Assignee: Stemcor, Cleveland, Ohio

[21] Appl. No.: 191,459

[22] Filed: May 9, 1988

Related U.S. Application Data

[63] Continuation of Ser. No. 28,281, Mar. 20, 1987, abandoned, which is a continuation of Ser. No. 723,984, Apr. 16, 1985, abandoned.

[51] Int. Cl.[4] ..... B01J 8/02

[52] U.S. Cl. ..... 422/179; 29/515; 422/180; 428/236

[58] Field of Search ..... 422/171, 177, 179, 180, 422/169; 428/236; 29/515

[56] References Cited

U.S. PATENT DOCUMENTS

| | | | |
|---|---|---|---|
| 3,227,241 | 1/1966 | Mattoon | 422/180 X |
| 3,798,006 | 3/1974 | Balluff | 422/179 |
| 3,876,384 | 4/1975 | Santiago et al. | 422/179 |
| 3,891,396 | 6/1975 | Musall et al. | 422/179 |
| 3,916,057 | 10/1975 | Hatch et al. | 428/236 |
| 4,048,363 | 9/1979 | Langer et al. | 422/180 X |
| 4,142,864 | 3/1979 | Rosynsky et al. | 422/179 |
| 4,239,733 | 12/1980 | Foster et al. | 422/180 X |
| 4,256,700 | 3/1981 | Smith et al. | 422/171 X |
| 4,269,807 | 5/1981 | Bailey et al. | 422/179 |
| 4,328,187 | 5/1982 | Musall et al. | 422/179 |
| 4,353,872 | 10/1982 | Midorikawa | 422/179 |
| 4,385,135 | 5/1983 | Langer et al. | 422/179 X |
| 4,425,304 | 1/1984 | Kawata et al. | 422/171 |
| 4,432,943 | 2/1984 | Musall et al. | 422/180 X |

*Primary Examiner*—Michael S. Marcus
*Assistant Examiner*—Jill Johnston
*Attorney, Agent, or Firm*—Michael F. Esposito; Joseph G. Curatolo; Larry W. Evans

[57] ABSTRACT

A device suitable for use as a catalytic converter for purification of the exhaust gases from an internal combustion engine at continuous operating temperatures in excess of 1600° F. and up to 2500° F. includes a frangible ceramic monolith catalyst element resiliently mounted in a metallic housing. The monolith is wrapped in a thermally insulating layer of ceramic fibers capable of withstanding continuous exposure to temperatures of at least 2000° F. A layer of intumescent material disposed between the housing and the ceramic fiber layer resiliently secures the monolith in the housing. A method of manufacture of such a device is also described.

20 Claims, 1 Drawing Sheet

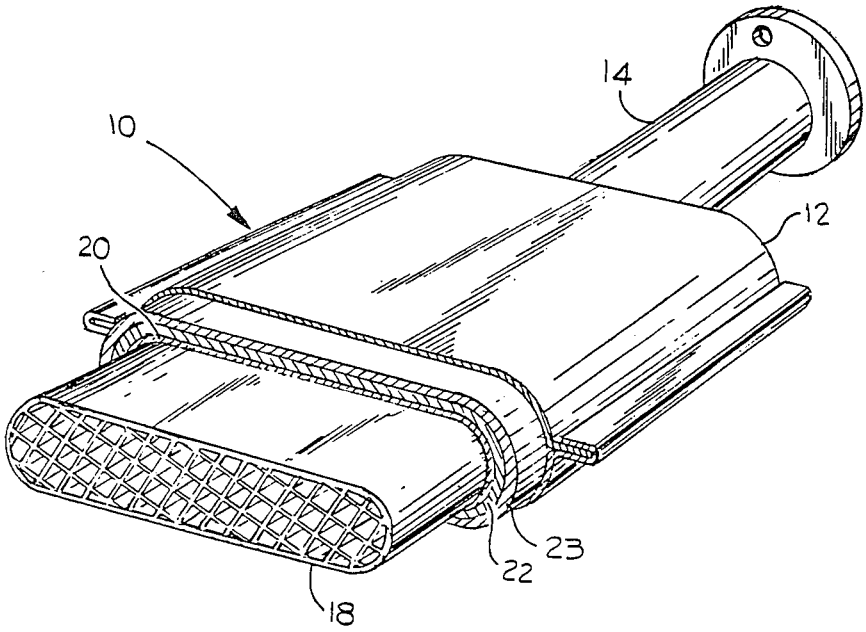
14
10
12
20
23
22
18

MONOLITHIC CATALYTIC CONVERTER MOUNTING ARRANGEMENT

This is a continuation of co-pending application Ser. No. 028,281 filed Mar. 20, 1987, now abandoned which in turn is a continuation of application Ser. No. 723,984 filed Apr. 16, 1985, now abandoned.

The present invention relates to a device for treatment of exhaust gases from an internal combustion engine, e.g. a catalytic converter. More specifically, the present invention relates to such devices which include as their catalytic member a frangible ceramic monolith including a plurality of flow channels on which catalyst material is deposited for interaction with said exhaust gases and to an improved mounting for such monolith.

BACKGROUND OF THE INVENTION

Such monoliths may be formed of a brittle fireproof ceramic material such as aluminum oxide, silicon oxide, magnesium oxide, zircon silicate, cordierite or silicon carbide and the like. These ceramic materials provide a skeleton type of structure with a plurality of tiny flow channels. Small shockloads are sufficient to crack or crush the monolith. Due to this brittleness problem which exists when using this type of catalytic device in connection with motor vehicles in which the ceramic monolith is located in a housing connected to the exhaust gas system, much effort has been expended in developing means for support of the monolith in its housing so that the monolith would be substantially free of shockloads. Representative of these efforts are the following:

U.S. Pat. No. 3,798,006 discloses securement of a monolithic type catalyst element in its housing by a differentially hardened fibrous lining. The monolith is supported by a felted layer or sleeve of ceramic fibers which are compressed between the monolith and a shell. After assembly, a suitable rigidizer, binder and adhesive liquid containing a high temperature-resistant material such as aqueous colloidal silica is applied to the compressed layer of ceramic fiber material. The treated unit is thereafter dried in a manner so as to cause migration of the silica solids to the exposed ends of the sleeve of ceramic fiber.

U.S. Pat. No. 3,876,384 discloses a monolithic catalyst carrier body which is resiliently mounted in a reactor casing by surrounding the monolith with a protective jacket which includes highly heat-resistant steel reinforcing means embedded in ceramic fiber and binder means, which itself includes a fireproof mortar. The monolith is enveloped by a protective jacket comprising an inner layer and outer layer of ceramic or mineral fibers which are embedded in a heat-resistant mortar. Steel reinforcing strips are embedded between the ceramic fiber layers and grip both of the ceramic fiber layers.

U.S. Pat. No. 3,891,396 discloses an elastic holder for monolithic catalyst bodies. The holder consists of a metallic corrugated tube which simultaneously forms the outer wall of the exhaust conduit. This corrugated tube is provided with a mechanical bias which safely holds the monolithic catalyst body and presses it against an end bearing. The monolithic body may be surrounded at its outer surface with elastic heat-resistant material in the form of ceramic wadding disposed in the space between the corrugated tube and the catalyst body or its ceramic sleeve. The catalyst body may be cemented with a heat-resistant cement to a ceramic sleeve which serves to thermally insulate the corrugated tube from hot exhaust gases.

U.S. Pat. No. 3,916,057 discloses a process for mounting monolithic catalyst support elements which utilizes an intumescent sheet material containing vermiculite or other expandable mica. The intumescent sheet material functions as a resilient mounting material by expansion in situ. The thermal stability and resilience of the sheet after exfoliation compensate for the difference in thermal expansion of the metal canister and the monolith and absorbs mechanical vibrations transmitted to the fragile monolith or forces which would otherwise be imposed on the monolith due to irregularities in the metallic or ceramic surfaces.

U.S. Pat. No. 4,048,363 discloses an offset laminated intumescent mounting mat for use in wrapping a ceramic catalytic monolith. After heating, expansion of the intumescent material in the mat secures the monolith in its housing or covering.

U.S. Pat. No. 4,142,864 discloses mounting of a catalytic ceramic monolith by positioning a resilient, flexible ceramic fiber mat or blanket in the space between the catalytic monolith and the inner surface of the casing. This blanket is compressed upon installation of annular plug members which are inserted at each end of the ceramic monolith between it and the casing. The plugs may be formed of solid metal, wire mesh or hollow metal.

U.S. Pat. Nos. 4,239,733 and 4,256,700 disclose a catalyst coated ceramic monolith supported in a sheet metal housing by both a wire mesh sleeve and an intumescent sleeve which are positioned adjacent each other in non-overlapping fashion.

U.S. Pat. No. 4,269,807 discloses a resilient mounting for a ceramic catalytic monolith in which the monolith is surrounded with a blanket of knitted wire mesh which is partially compressed throughout its length. Overlying the knitted wire mesh is a band of high-temperature intumescent material containing ceramic fibers as a viscous caulking or paste within the matrix of the metal mesh. Among the constructions disclosed is one which includes machining the ceramic monolith to remove $\frac{1}{8}$ inch from its diameter and coating it with ceramic fibers of the corresponding thickness followed by surrounding with a blanket of knitted wire mesh.

U.S. Pat. No. 4,305,992 discloses flexible intumescent sheet materials suitable for use in mounting autmotive catalytic converter monoliths. These materials contain unexpanded ammonium ion-exchanged vermiculite flakes.

U.S. Pat. No. 4,328,187 discloses an elastic holder for axial suspension of a ceramic catalytic monolith within a housing. The monolith is surrounded with a layer of heat-resistant mineral fiber material. Overlying this fiber layer is a jacket or sleeve of good heat-insulating mineral material. Overlying the sleeve is a layer made from a highly-elastic material such as foam, asbestos or glass fiber fleece, or from a metallic wire mesh cushion which serves as a damping element which extends within the housing over the entire length of the monolith and elastically suspends the monolith together with its ceramic fiber wrapping and sleeve against the walls of the housing.

U.S. Pat. No. 4,335,077 discloses support of a ceramic catalytic monolith by means of elastically deformable damping rings or envelopes. In one embodiment the monolith is surrounded by a protective jacket of heat-resistant cement or putty reinforced with ceramic fibers. This protective jacket may be reinforced with metal in the form of a wire mesh or the like. The protective jacket is enveloped around its circumference by a soft mineral fiber layer which is compressed between the housing wall and the protective jacket.

U.S. Pat. No. 4,353,872 discloses support of a ceramic catalytic monolith within its casing by means of a gas seal member formed of heat-resistant and expandable sheet material, for example, vermiculite, quartz or asbestos, which envelopes a portion of the monolith. Longitudinally displaced therefrom is a separate layer of generally cylindrically knitted wire or resilient support which is disposed between the monolith and its casing to dampen external forces applied to the monolith.

U.S. Pat. No. 4,425,304 discloses a catalytic converter in which ceramic catalytic monoliths are supported by an elastic pad of expanded metal or steel mesh fabrics or a knitted web of ceramic fibers at their ends and are wrapped with respective cushioning layers of expanded metal or any other known flame-retardant, corrosion-resistant cushioning material.

U.S. Pat. No. 4,432,943 discloses an elastic suspension for a monolithic catalyst body in which the annular space between the housing and the catalyst body is filled with heat-resistant mineral fiber material which serves to prevent bypass of exhaust gas and as thermal insulation. In another construction the monolith is surrounded by a mineral fiber layer and a rigid sleeve of heat-resistant metal is positioned over the mineral fiber layer. The annular space between the sleeve and the housing may be filled with ceramic fiber.

Many of the aforedescribed means for support of a ceramic catalytic monolith have been adopted commercially for use in connection with gasoline powered passenger automobiles. In this type of service, the maximum converter temperatures are generally under 1600° F. When attempts have been made to secure the ceramic monolith utilizing materials such as those disclosed in U.S. Pat. Nos. 3,916,056 and 4,305,992 in vehicles having a higher gross vehicle weight (GVW), failures have occurred which are believed due to failure of known intumescent sheet materials. One mode of failure observed is fragmentation of the ceramic monolith, another mode of failure has been shredding of the intumescent sheet material and consequent plugging of the next monolith in sequence. Large passenger automobiles may utilize catalytic converters which include two ceramic monoliths. Vehicles of higher gross vehicle weight, e.g. trucks, may require four serially arranged monoliths. Because of their high GVW, the engines of such vehicles operate at a much higher percentage of their maxiumum output, a much greater percentage of their operating time, than do the engines in passenger automobiles. These operating conditions in heavier vehicles result in maximum catalytic converter temperatures of much greater than 1600° F. Converter monolith temperatures of 2000° F. are not uncommon and temperatures of 2500° F. may be encountered.

A typical passenger automobile catalytic converter utilizes a ceramic monolith which is supported by intumescent sheet material like that described in U.S. Pat. Nos. 3,916,057 or 4,305,992, having a nominal thickness of 0.195 inch and a nominal density of 40 pcf. This material is compressed during installation of the ceramic monolith into its metallic shell to a nominal thickness of 0.130 inch and a nominal density of about 60 pounds per cubic foot (pcf). Such a construction does not withstand the higher operating temperatures often encountered in the operating cycle of a higher GVW vehicle such as a truck. To overcome these deficiencies, it has been suggested that the overall nominal thickness of the compressed installed intumescent layer be increased to about 0.24 inch and the nominal density be increased to about 65–70 pounds per cubic foot as installed. While this latter construction does not immediately fail, it has been found after operation for a period of time that the layer of intumescent sheet material adjacent the catalytic converter was totally degraded, thus giving rise to the possibility of such degraded layer shredding and plugging the next monolith in sequence or the degradation continuing until the pre-compression force is released and the monlith is free to bounce about within the shell and self-destruct due to mechanical shock.

BRIEF SUMMARY OF THE INVENTION

The primary purpose of this invention is to provide an improved mounting for a frangible ceramic catalytic monolith which is suitable and very convenient for mass manufacture and for use in the exhaust systems of automotive internal combusion engines, particularly where converter operating temperatures of 2000° F. or more are anticipated.

According to the present invention, this purpose is accomplished by provision of a device for treatment of exhaust gases from an internal combustion engine comprising:

(a) a housing having an inlet at one end and an outlet at its opposite end through which exhaust gases flow;

(b) a frangible ceramic monolith resiliently mounted within said housing, said monolith having an outer surface and an inlet end face at one end in communication with said inlet of said housing and an outlet end face at its opposite end in communication with said outlet of said housing;

(c) a ceramic fiber layer in contact with and covering at least a portion of said outer surface of said monolith; and (d) an intumescent layer disposed between said housing and said ceramic fiber layer.

According to another aspect of the present invention, there is provided a catalytic converter for purifying exhaust gases of an internal combustion engine comprising:

(a) a hollow metallic housing having an inner surface and inlet at one end and an outlet at the other end;

(b) a frangible gas-pervious ceramic monolith catalyst element resiliently mounted within said housing, said catalyst element having an inlet end face in communication with said inlet of said housing and an outlet end face in communication with said outlet end of said housing;

(c) means thermally insulating and resiliently mounting said catalyst element in spaced relationship from said housing comprising;

(d) a layer of ceramic fibers capable of resisting continuous exposure to temperatures of at least 2000° F. covering and in contact with at least 70 percent of said outer surface of said catalyst element between its end faces; and at least one layer of intumescent sheet material covering said ceramic fiber layer and contacting said housing.

DESCRIPTION OF THE DRAWING

FIG. 1 is a fragmentary isometric view of a device embodying the invention.

DETAILED DESCRIPTION OF THE INVENTION

Referring to the FIGURE, there is shown at numeral 10 a catalytic converter generally. Catalytic converter 10 includes a generally tubular housing 12 formed of two pieces of metal, e.g. high temperature-resistant steel. Housing 12 includes an inlet 14 at one end and an outlet (not shown) at its opposite end. The inlet 14 and outlet are suitably formed at their outer ends whereby they may be secured to conduits in the exhaust system of an internal combustion engine. Device 10 contains a frangible ceramic monolith 18 which is supported and restrained within housing 12 by layers 20, 22 and 23 to be further described. Monolith 18 includes a plurality of gas-pervious passages which extend axially from its inlet end face at one end to its outlet end face at its opposite end. Monolith 18 is constructed of a suitable refractory or ceramic material in known manner and configuration. Monolith are typically oval or round in cross-sectional configuration.

In accordance with the present invention, the monolith is spaced from its housing at least about 0.2 inch. The outer surface of monolith 18 is wrapped with a layer 20 of ceramic fibers. Preferably, for intended monolith operating temperatures of up to 2000° F., the ceramic fiber layer 20 has an installed nominal thickness of at least 0.03 inch and an installed nominal density of at least about 40 pcf. Overlying this layer 20 of ceramic fibers there is provided a layer 22, 23 of intumescent sheet material which is in contact with the ceramic fiber layer 20 and the metal housing 12. Preferably, the intumescent layer 22, 23 has an installed (compressed) nominal thickness of at least about 0.2 inches and an installed nominal density of about 70 pcf.

Preferably and conveniently, layer 20 is in the form of ceramic fiber paper. However, other ceramic fiber forms such as blanket, mat or felt may be employed, provided they impart the necessary thermal insulation and mechanical support as provided by a layer of ceramic fiber paper.

While in FIG. 1 the intumescent material is shown to be provided in the form of layers 22 and 23, which are superposed upon ceramic fiber layer 20, a single layer of intumescent material may be employed if available in the requisite thickness and density. The ceramic fiber paper may be laminated to the intumescent layer prior to assembly in a catalytic device.

Ceramic fiber papers suitable for use in the present invention are preferably free of vermiculite. Small amounts of vermiculite may be present in the ceramic fiber paper layer, e.g. up to about 30 weight percent; however, the presence of such vermiculite is not recommended and may reduce the service temperature and life of monolithic catalytic converters employing such ceramic fiber paper. The presence of vermiculite, including ammonium-ion exchanged types, may reduce the effectiveness of the ceramic fiber layer, particularly by causing its degradation at temperatures lower than that of the ceramic fibers in the absence of vermiculite.

An eminently suitable material for monolith temperatures up to 2300° F. for ceramic fiber layer 20 has been found to be Fiberfrax ® 970 paper available from Sohio Engineered Materials Company, Niagara Falls, New York. This product is made from bulk alumino-silicate glassy fiber having approximately 50-50 alumina/silica and a 70/30 fiber/shot ratio. About 93 weight percent of this paper product is ceramic fiber/shot, the remaining 7 percent being in the form of an organic latex binder. For even higher monolith temperatures, papers produced from Fibermax TM polycrystalline mullite ceramic fibers available from this manufacturer may be employed. Alumina fibers may also be employed where high monolith temperatures are expected.

In a typical assembly intended for use with 2–10 ton trucks, the ceramic monolith is of round cross-sectional configuration and measures approximately 6 inches in diameter and has a length of about 3 inches. For the construction of a converter whose monolith is expected to operate at temperatures up to 2500° F., a layer of Fibermax TM ceramic fiber paper having a nominal uncompressed thickness of about 0.125 inch and a nominal uncompressed density of about 12 pcf is wrapped around each monolith. Thereafter, two layers of intumescent sheet material like that described in U.S. Pat. Nos. 3,916,057 or 4,305,992, each having a nominal uncompressed thickness of about 0.200 inch and a nominal uncompressed density of 40 pcf, are wrapped around the layer of ceramic fiber paper. This combination of monolith, ceramic fiber paper and intumescent sheet material layers is then inserted into one of the members corresponding to those which form housing 12. Thereafter, the assembly is installed by radially compressing between the members of the housing so that the combined thickness of the ceramic fiber paper and intumescent sheet material layers is reduced to about $\frac{1}{4}$ inch and the density of the combined layers is increased to about 70 pounds per cubic foot. Preferably, the ceramic fiber layer and intumescent layers extend longitudinally at least about 70 percent of the monolith length. Preferably, the ceramic fiber and intumescent layers do not extend beyond the length of the monolith. The metal housing extends beyond the ends of the monolith. After compression of the members forming the housing, their edges are either folded over as illustrated in FIG. 1 or welded longitudinally to form a gas-tight housing.

While not completely understood, there appears to be a direct relationship between the density of the ceramic fiber paper layer and intumescent material layers and the maximum use temperature of the catalytic device. For example, when the maximum intended monolith service temperature is about 1600° F., adequate service life is provided when vermiculite-containing intumescent material, according to U.S. Pat. Nos. 3,916,056 and 4,305,992 is alone employed at an installed density of about 45–60 pcf. When the maximum intended monolith service temperature is elevated to 1825° F., adequate service life may be obtained if the installed density of such intumescent material layers is about 70 pcf.

When the maximum intended service temperature of the monolith is elevated to 2000° F., such intumescent sheet material, even at an installed density of 70 pcf and an installed thickness of 0.240, degrades adjacent the monolith. Laboratory experiments indicate that provision of a 0.035-inch installed thickness and 43 pcf installed density ceramic fiber paper layer reduces the temperature at interface of the ceramic fiber paper and such intumescent sheet material by 107°–114° F. Preferably, the ceramic fiber paper layer is of sufficient thickness to limit the maximum temperature of the intumescent layer to less than 1900° F. and more desirably to 1850° F. or less.

Increasing or decreasing the installed density of the ceramic fiber and intumescent material layers does not significantly change the thermal insulation properties of these layers per unit of thickness, but does significantly affect the restraining force imposed on the monolith. The restraining force at 75° F. increases directly with an increase in installed density.

While a presently preferred embodiment of the invention has been illustrated and described, it will be apparent to those skilled in the art that modifications thereof are within the spirit and scope of the invention. For example, the monolith may be an electrically resistant-heated element. The monolith may serve as a regenerable particulate trap. For example, in assemblies where even higher monolith operating temperatures are anticipated, e.g. 2500° F., the ceramic fiber paper layer which is in contact with the monolith should be formed, for example, of Fibermax TM polycrystalline mullite fibers or of alumina fibers to thermally insulate the radially outer layers of vermiculite-containing intumescent material from exceeding their maximum continuous use temperature. The ceramic monolith may be first wrapped in polycrystalline alumino-silicate fiber, then wrapped with vitreous alumino-silicate fiber and then wrapped with intumescent material. The outside temperature of the housing of the catalytic converter may be reduced by increasing the thickness of the combined ceramic fiber and intumescent material layers. For simplicity of illustration, housing 12 has been shown to be smooth. In most applications, however, it is recommended that the housing be ribbed or otherwise reinforced to stiffen it to resist the force exerted by the compressed ceramic fiber paper and intumescent sheet materials.

"Ceramic fibers" as used herein include those formed from basalt, industrial smelting slags, alumina, alumino-silicates and chrome, zircon and calcium modified alumino-silicates and the like.

What is claimed is:

1. Device for treatment of exhaust gases from an internal combustion engine comprising:

(a) a housing having an inlet at one end and an outlet at its opposite end through which exhaust gases flow;

(b) a frangible ceramic monolith resiliently mounted within said housing, said monolith having an outer surface and an inlet end face at one end in communication with said inlet of said housing and an outlet end face at its opposite end in communication with said outlet of said housing;

(c) a ceramic fiber layer in contact with and covering at least a portion of said outer surface of said monolith; and (d) an intumescent layer disposed between said housing and said ceramic fiber layer.

2. The device of claim 1 wherein said ceramic fiber layer is selected from the group consisting of ceramic fiber mat, ceramic fiber blanket, ceramic fiber felt or ceramic fiber paper.

3. The device of claim 1 in which said ceramic fiber layer is ceramic fiber paper which contains less than 30 percent by weight of vermiculite, which paper is capable of resisting continuous exposure to temperatures of at least 2000° F.

4. The device of claim 3 in which the ceramic fiber paper is of a thickness sufficient to limit the maximum temperature of the intumescent layer to less than about 1900° F. when the monolith is at a continuous operating temperature not exceeding 2500° F.

5. The device according to claim 3 wherein the ceramic fiber paper has an installed nominal thickness of at least 0.035 inches and an installed nominal density of at least 40 pounds per cubic feet.

6. The device of claim 1 in which said ceramic fiber layer is vermiculite-free ceramic fiber paper.

7. The device of claim 6 wherein the intumescent layer contains ion-exchanged vermiculite and the ceramic fiber layer limits the maximum temperature of the intumescent layer to not more than 1850° F. during continuous treatment of exhaust gases.

8. The device of claim 7 wherein the monolith is suitable for an operating temperature of greater than 1900° F.

9. The device of claim 7 wherein the monolith is suitable for an operating temperature of at least 1950° F.

10. The device of claim 1 in which said ceramic fiber layer is of a thickness sufficient to limit the maximum temperature of the interface between the intumescent layer of the ceramic fiber layer to less than 1850° F. when the monolith is at a continuous operating temperature not exceeding 2500° F.

11. A catalytic converter for purifying exhaust gases of an internal combustion engine comprising:

(a) a hollow metallic housing having an inner surface and inlet at one end and an outlet at the other end;

(b) a frangible gas-pervious ceramic monolith catalyst element resiliently mounted within said housing, said catalyst element having an inlet end face in communication with said inlet of said housing and an outlet end face in communication with said outlet end of said housing;

(c) means thermally insulating and resiliently mounting said catalyst element in spaced relationship from said housing comprising:

(d) a layer of ceramic fibers capable of resisting continuous exposure to temperatures of at least 2000° F. covering and in contact with at least 70 percent of said outer surface of said catalyst element between its end faces; and (e) at least one layer of intumescent sheet material covering said ceramic fiber layer and contacting said housing.

12. The catalytic converter of claim 11 wherein said layer of ceramic fibers is selected from the group consisting of ceramic fiber mat, ceramic fiber blanket, ceramic fiber felt or ceramic fiber paper.

13. The catalytic converter of claim 11 wherein said inner layer of ceramic fibers has an uncompressed nominal thickness of at least 1/16 inch and an uncompressed nominal density of at least 12 pcf.

14. The catalytic converter of claim 13 wherein said intumescent sheet material layer has an uncompressed nominal density of about 40 pcf.

15. The catalytic converter of claim 14, including two layers of intumescent sheet material, each having an uncompressed nominal thickness of about 0.2 inch.

16. The catalytic converter of claim 11 wherein the ceramic fiber layer has an installed nominal thickness of at least 0.030 inch and an installed nominal density of at least 40 pounds per cubic foot.

17. The catalytic converter of claim 16 wherein said catalyst monolith element is spaced from said housing at least about 0.2 inch.

18. The catalytic converter of claim 16 wherein said intumescent sheet material has an uncompressed nominal thickness of about 0.4 inches, an uncompressed nominal density of about 40 pcf and the installed ceramic fiber layer and intumescent sheet material layers have a combined thickness of about $\frac{1}{4}$ inch and a combined density of about 70 pcf.

19. The catalytic converter of claim 11 wherein the monolith element is wrapped with a layer of ceramic fiber paper which comprises about 93 weight percent ceramic fiber having about a 70/30 fiber-to-shot ratio, said ceramic fiber being alumino-silicate glassy fiber having an alumina content of about 50 weight percent, said ceramic fiber paper having an installed thickness of about 0.035 inches and an installed density of about 43 pounds per cubic foot and said intumescent layer includes two layers of a material comprising from about 40 to about 65 weight percent unexpanded vermiculite flakes which have been treated in an aqueous ammonium solution to substantially complete the ion exchange with $NH_4+$cations, from about 25 to about 50 weight percent inorganic fibrous material and from about 5 to about 15 percent of binder, said intumescent layer upon exposure to heat in excess of 350° C. undergoing thermal expansion.

20. A method of mounting a gas-pervious ceramic monolith catalyst element having inlet and outlet end faces within a housing comprising the steps of:

(a) wrapping a layer of ceramic fiber paper around the monolith between its inlet and outlet end faces;

(b) wrapping said ceramic fiber paper layer wrapped monolith with intumescent sheet material to form an assembly; and (c) forming a housing around said assembly in which said ceramic fiber paper and intumescent sheet material are radially compressed between said monolith and said housing.

* * * * *